United States Patent [19]

Gruber et al.

[11] Patent Number: 5,040,451

[45] Date of Patent: Aug. 20, 1991

[54] RADIAL PISTON PUMP OR MOTOR HAVING PRESSURE ZONES ON THE CONTROL TAP FOR BALANCING THE PUMP BODY

[75] Inventors: Juergen Gruber, Aichtal; Wilhelm Zirps, Hemmingen, both of Fed. Rep. of Germany

[73] Assignee: Robert Bosch GmbH, Stuttgart, Fed. Rep. of Germany

[21] Appl. No.: 586,327

[22] Filed: Sep. 19, 1990

Related U.S. Application Data

[63] Continuation-in-part of Ser. No. 329,220, Mar. 24, 1989, abandoned.

[30] Foreign Application Priority Data

May 19, 1988 [DE] Fed. Rep. of Germany ..... 3816998

[51] Int. Cl.[5] ..... F01B 13/06; F16C 33/10

[52] U.S. Cl. ..... 91/498; 384/291

[58] Field of Search ..... 91/498; 384/113, 115, 384/291

[56] References Cited

U.S. PATENT DOCUMENTS

| | | | |
|---|---|---|---|
| 2,449,297 | 9/1948 | Hoffer | 384/115 |
| 3,875,852 | 8/1975 | Bosch | 91/498 |
| 3,893,376 | 6/1975 | Nonnenmacher | 92/55 |
| 3,985,065 | 10/1976 | Nonnenmacher et al. | 91/498 |
| 4,576,488 | 3/1986 | Steiner et al. | 384/291 |

FOREIGN PATENT DOCUMENTS

| | | | |
|---|---|---|---|
| 2236125 | 6/1972 | Fed. Rep. of Germany | 91/498 |
| 2239757 | 8/1972 | Fed. Rep. of Germany | 91/498 |

*Primary Examiner*—Leonard E. Smith
*Assistant Examiner*—John A. Savio, III
*Attorney, Agent, or Firm*—Edwin E. Greigg; Ronald E. Greigg

[57] ABSTRACT

In an apparatus having a radial piston device, in particular a radial piston pump or motor or the like, a pump body rotates around a control tap. Radially moving pistons are supported in the pump body and with the control tap define a pumping chamber for a fluid medium. This pumping chamber can be connected to both an intake bore and a pressure bore. Further, pressure zones are found on the jacket face of the control tap, between the control tap and the pump body, so that as a result the pump body is mainly supported by hydrostatic forces. These pressure zones are intended to comprise intersecting conduits, with segments of the jacket face remaining between them.

25 Claims, 5 Drawing Sheets

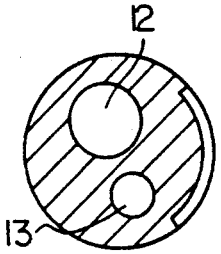
FIG. 6
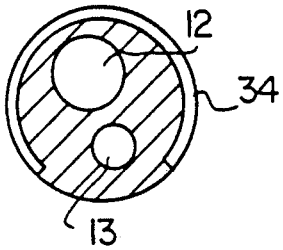
FIG. 7
FIG. 8
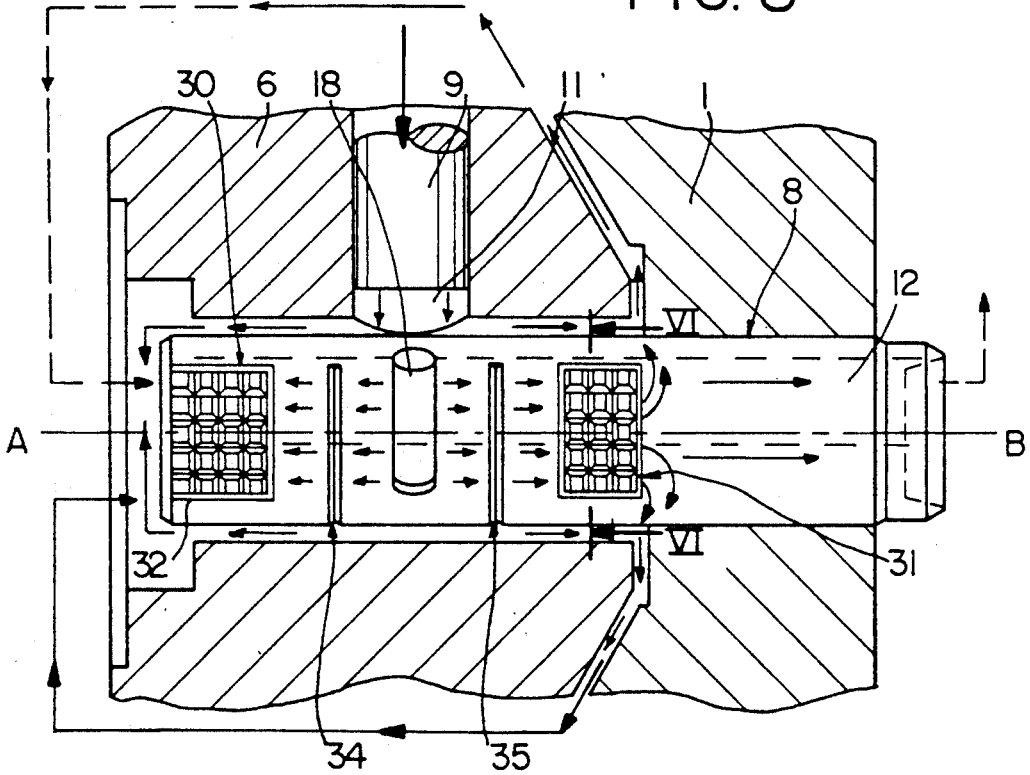
FIG. 9
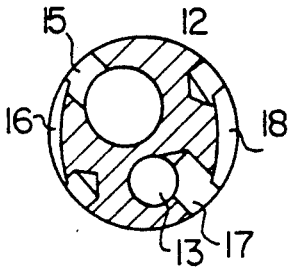
FIG. 10
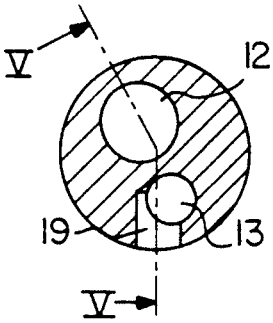

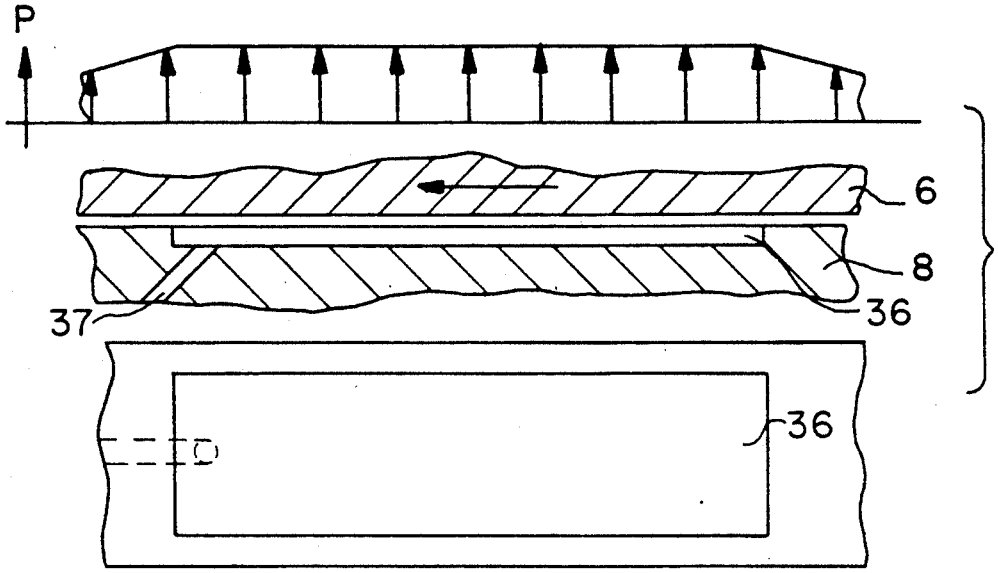
FIG. 11 PRIOR ART
FIG. 12
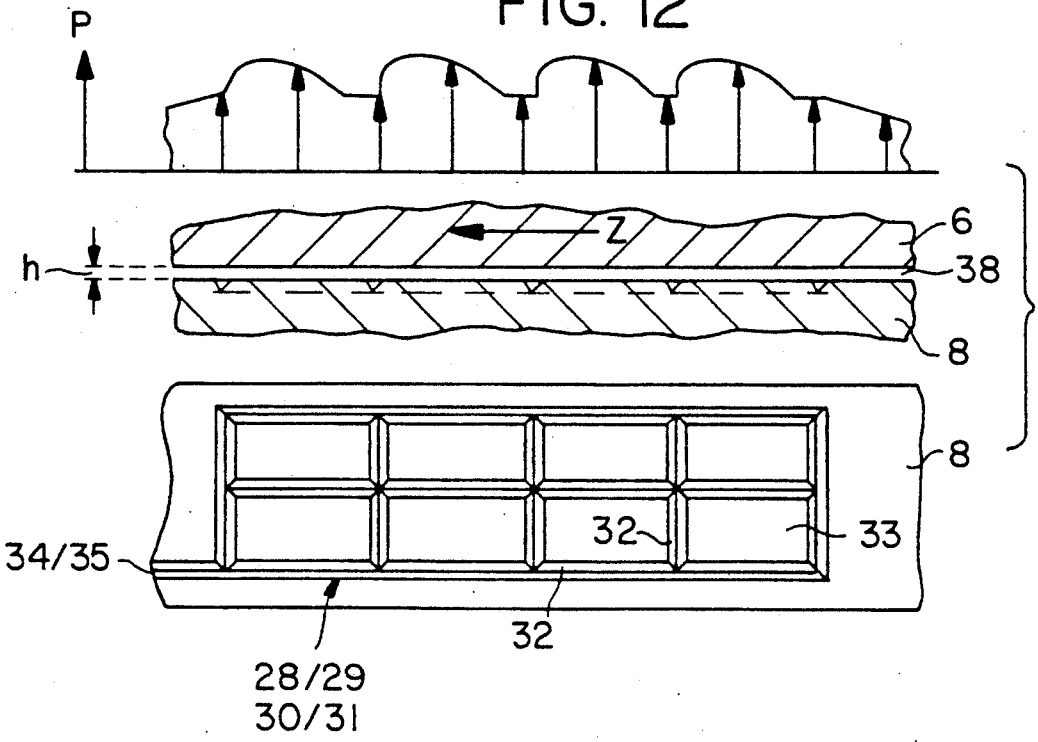

RADIAL PISTON PUMP OR MOTOR HAVING PRESSURE ZONES ON THE CONTROL TAP FOR BALANCING THE PUMP BODY

This is a continuation-in-part of application Ser. No. 329,220, filed on Mar. 24, 1989, now abandoned.

BACKGROUND OF THE INVENTION

The invention concerns an apparatus having a radial piston device, in particular, a radial piston pump or motor or the like.

Such radial piston devices, where they have been used in radial piston pumps, for instance, are also used to handle low-viscosity fluids such as brake fluid. In such pumps, the sealing gaps must of necessity be particularly long in order to keep pumping losses low. In this type of pump, this leads to long fluid flow control taps and correspondingly wide pump bodies. The pressure-absorbing conduits in the fluid flow control taps exert a unilateral pressure force on the pump body, a pressure which increases with increasing width of the body. These forces must be compensated for by correspondingly arranged pressure-absorbing zones.

To compensate for these forces, DE-OS 2 236 125 for instance provides pockets molded into the fluid flow control taps in such a fashion that they lie offset to the sides of the control openings and are periodically connected to the cylinder openings in the control taps. DE-OS 22 39 757 also shows pocket-like pressure zones on the output and intake sides; these are diagonally connected and supplied with pressurized fluids through the gap between the pump body and the control tap. Similar arrangements are also to be found in U.S. Pat. No. 3,893,376 and U.S. Pat. No. 3,875,852.

These pocket-like pressure zones have the disadvantage that, even when the pump body is rotated relative to the fluid flow control taps, no appreciable directional fluid movement occurs, so that the pressure in all areas of the chamber is approximately equal, and the force acting on the pump body is the same both in size and direction. This is disadvantageous when, as described above, long control taps produce a one-sided force acting on the pump body which must be met at this point with a increased counter-pressure.

OBJECT AND SUMMARY OF THE INVENTION

An apparatus having a radial piston device in the embodiment described herein contains uniquely constructed pressure zones, comprising intersecting conduits and between which segments of the control tap jacket face remain.

Neither the size, the number nor the shape of the zones, their position around the control tap, nor their supply of pressurized fluids via gaps, bores, etc. individually plays a major role within the scope of the invention. Of sole importance is that the pressure zone comprises a network of supply conduits. For this, the height and width of the conduits are naturally more than one hundred times greater than the height of the gap between the pump body and the control tap. This keeps the flow rate in the conduits low so that almost equal pressure prevails throughout the network. Also, all the jacket face segments are under pressure when the pump is not in operation.

If the pump body is then rotated relative to the fixed control tap, a drag current arises in the gap over the corresponding face segment; that is, fluid is dragged along in the direction of rotation of the pump body.

Depending on whether this gap height is increasing or decreasing in the direction of rotation, the dynamic and static pressure will either be added or subtracted to or from one another. The force from the pressure zone arising from this will increase as the gap narrows and decrease as it widens.

If the pump body presses against a pressure zone at the control tap, a decreasing gap above the pressure zone, with a corresponding increase in pressure, results. If, on the other hand, the force from the pressure zone is larger, the gap increases and there is a corresponding drop in pressure. These pressure changes act in a stabilizing fashion on the pump body inasmuch as they are constantly striving to achieve a concentric position of the bearing opening in the pump body with respect to the control tap.

In the preferred embodiment described here, pressure zones are disposed radially opposite a pressure conduit through which the transported medium moves from the pumping chamber to the pressure bore. Preferably, these pressure zones lie on either side of the corresponding intake conduit which connect the pumping chamber with the intake bore. These conduits are supplied by branch conduits which lead to the opposite side across the control tap jacket face.

These two conduits collect fluid leaked from the pressure conduit and deliver the fluid to the pressure fields. Since this leaked fluid is also under pressure, the pressure spreads over the entire area covered by the pressure zones and pressure zones whose force is equal but opposite to that of the pressure conduit are created on the side of the control tap opposite the pressure conduit.

Preferably however, corresponding pressure zones should also be placed on either side of the pressure conduit. These can then, for instance, be connected to the intake bore by corresponding openings so that pressurized fluid can reach them. These pressure zones also have a pressure reduction effect.

A particular advantage of the invention over the known pockets is that the pressure zones of the preferred embodiment or their network can be installed without metal cutting, for instance by rolling, stamping or etching of the control taps. This greatly reduces their production cost. It is further possible to produce pressure zones of an desired shape in this fashion.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 6 shows a cross section through the control tap from FIG. 8, along line VI—VI;

FIG. 7 shows a cross section through the control tap from FIG. 4, along line VII—VII;

FIG. 8 shows a top view of the other side of the control tap from FIG. 4 which further shows the fluid flow relative to a pair of pressure zones;

FIG. 9 shows a cross section through the control tap from FIG. 4 along line IX—IX;

FIG. 10 shows a cross section through the control tap from FIG. 4 along line X—X;

FIG. 11 graphically shows pressure distributed into pockets shown in a partial longitudinal section in a control tap as it is presently known, with a section of the corresponding top view of the control tap shown below it;

FIG. 12 shows a corresponding view of pressure zones constructed in accordance with the invention in the same control tap as in FIG. 11, and the effect on pressure distribution.

DESCRIPTION OF THE PREFERRED EMBODIMENT

Figure 1:
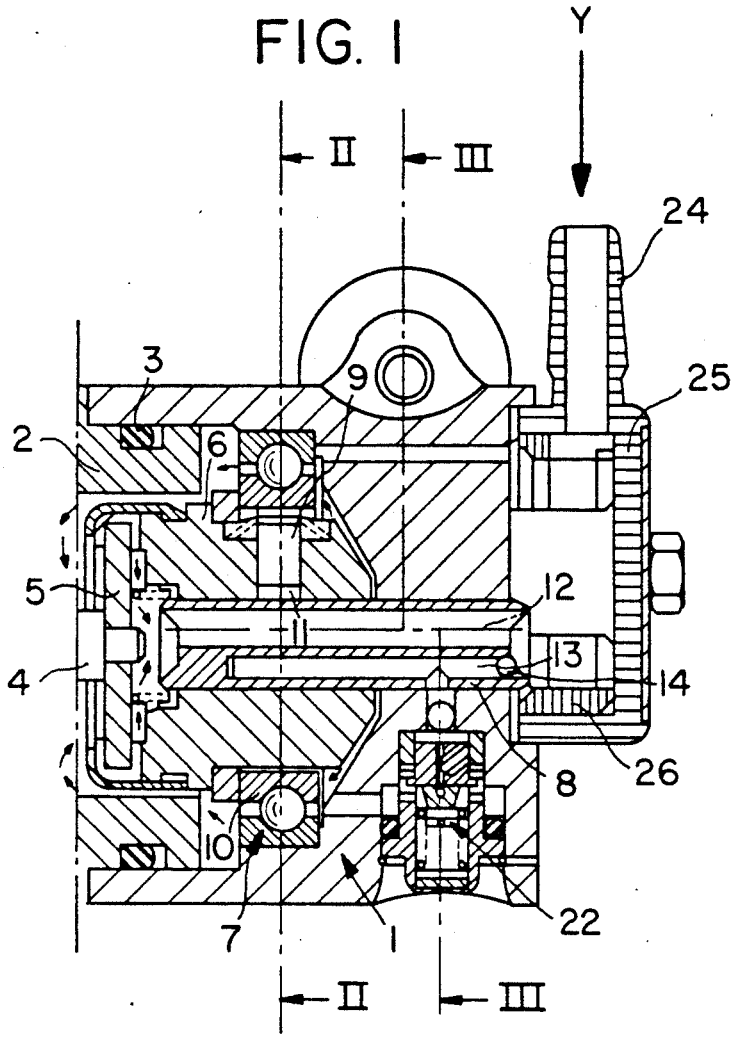
FIG. 1 shows a partial longitudinal section through a radial piston pump.

A radial piston pump has a pump housing 1 in accordance with FIG. 1 which has a partially shown flange 2 pushed onto the housing which is sealed by a circumferential O-ring 3. A pole tube, which is not shown, is connected to the flange 2 and contains, for instance, a DC motor, which is connected by a shaft 4 to a clutch 5.

A pump body 6 is driven by this clutch 5. This pump body 6 rotates in a ball bearing 7 around a control tap 8.

Figure 2:
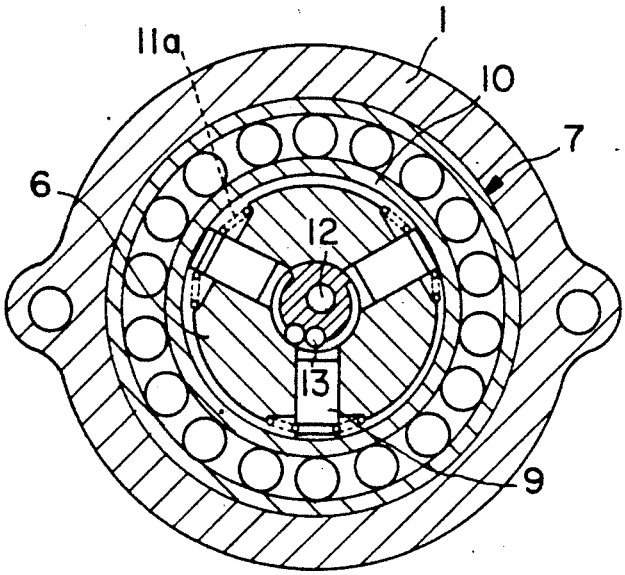
FIG. 2 shows a cross section through the radial piston pump from FIG. 1, along line II—II.

The pump body 6 is equipped with pistons 9 in an appropriate cylinder. The piston end faces are supported on the inner race 10 of the ball bearing 7 and are held in contact with the inner race 10 by springs 11*a* (see in particular FIG. 2).

In the unit shown in FIG. 1, the piston 9 along with the control tap 8 and the pump body 6 forms a pumping chamber 11 for the medium to be pumped. The control tap 8 is, in turn, fixedly pressed into the pump housing 1. Since the ball bearing 7 is eccentrically set with respect to the control tap 8 in the pump housing 1, the pistons 9 have a sinusoidal stroke relative to the pump body 6 when it is rotated. This changes the volume of the pumping chamber 11.

A continuous axially aligned parallel intake bore 12 and an axially aligned parallel pressure bore 13 embodied as a blind bore, whose face is closed by a ball 14, are located in the control tap 8.

Perpendicular to the intake bore 12, there is bore 15 shown in FIG. 9, which runs into a groove-shaped intake conduit 16. Also perpendicular to the pressure bore 13, there is bore 17 which cuts into a pressure conduit 18.

Figure 3:
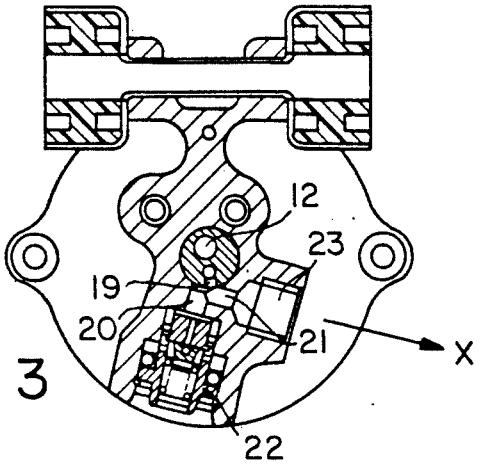
FIG. 3 shows a cross section through the radial piston pump from FIG. 1, along line III—III.
Figure 5:
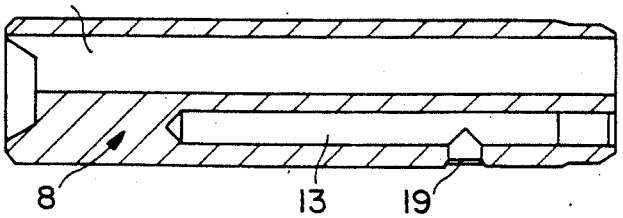
FIG. 5 shows longitudinal section of the control tap along line V—V from FIG. 10.

An outlet bore 19 (FIG. 1, 3, 5 and 10) to which two bores 20 and 21 in the housing 1 (FIG. 3) that are approximately perpendicular to another are connected and discharge from the pressure bore 13 (see FIGS. 5 and 10). The bore 20 leads to a pressure valve 22 which is shown in FIGS. 1 and 3 and not described in detail here, while the bore 21 communicates with a pressure connection 23. The pumped fluid medium flows from the connection 23 in the direction of the arrow x to any desired pressure system.

The fluid medium flows in the following manner during the pumping process: At an intake connection 24, the medium enters in the direction y shown by the arrow into a filter housing 25. It flows through the cylindrical filter 26 and reaches the pumping chamber 11 through the intake bore 12, the bore 15 and the intake conduit 16 in control tap 8, FIG. 9.

Rotation of the pump body 6 by approximately 180° causes the pistons 9—of which three are shown in this example—to move outward, thus filling the pumping chamber 11 of the piston cylinders, as the piston moves outwardly. If the pump body 6 continues to rotate, the pistons 9 push the media out of the pumping chamber 11 through the pressure conduit 18, the bore 17 and the pressure bore 13 in control tap 8, FIG. 9. From here the medium goes through the outlet bore 19 as well as the bores 20 and 21 to the pressure valve 22 and pressure connection 23, and thus out of the radial piston pump.

Figure 4:
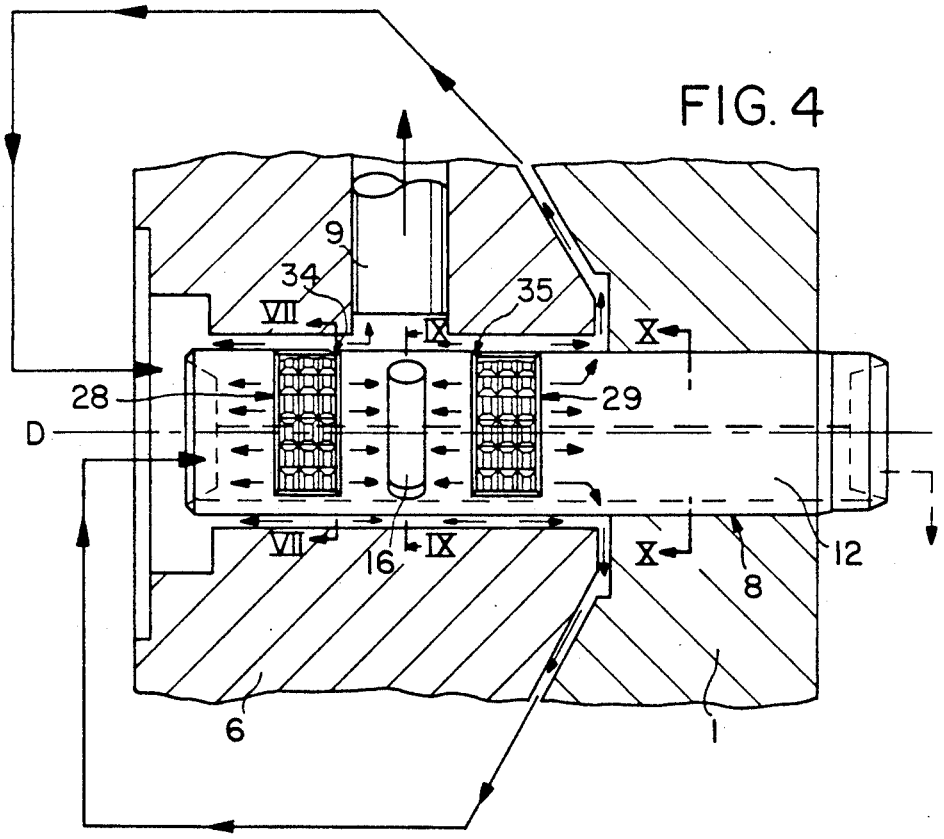
FIG. 4 shows a top view of the control tap with the pump housing shown in cross-section and illustrating fluid flow relative to one pair of pressure zones in accordance with the invention.

In order to prevent the metal parts of the pump body 6 and the control tap 8 from touching and thus wearing, the jacket face 27 of the control tap 8 (see FIG. 4) is provided with pressure zones 28 and 29, along a half-portion of control tap 8 adjacent to intake conduit 16 as well as pressure zones 30 and 31 in an opposite half-portion of control tap 8 which includes pressure conduit 18 (see FIG. 8). These pressure zones 28 to 31 consist primarily of intersecting conduits 32, as well as the jacket face segments 33 formed by the channels 32.

The conduits 32 of the pressure zones 28 and 29 are also connected by branch conduits 34 and 35, which run along both sides of the pressure conduit 18. These two branch conduits 34 and 35 gather leaked fluid from conduit 18 and delivers it to the pressure zones 28 and 29 arranged in a gridlike pattern in the opposite side surface of the control tap 8. Further, since there is a gap 38 between the pump body and the tap 8, fluid can flow along the jacket face 27 to the intake conduit 16 as well as to the radial spacing between the parts 1 and 6, as shown by the arrows in corrected FIG. 4.

Zones 30 and 31 have transverse conduits 32, extending in the radial and longitudinal directions of the control tap 8; the conduits of zone 30 are open on the left and they discharge in the housing 1 near the shaft 4, bordering on the 45° chamber of the left-hand end of the control tap 8, they discharge in the hosuing 1 and through it communicate with the left-hand end of the intake bore 12, as shown in FIG. 1.

There is a radially open gap between the right-hand end of the rotating pump body 6 and the pump housing 1, because of a spacing between these two components as shown in FIGS. 1 and 8. zone 31 is oriented such that the greater part of it is located inside the rotating pump body 6. The smaller part of this zone 31 penetrates the radial gap and protrudes farther by a very short distance into the bore of the housing. As a result, the transverse conduits 32 communicate with the radial gap and finally fluid follows a path through the ball bearing 7 and around the rotating pump body, they also communicate with the left-hand end of the intake bore, as has been indicated by arows on FIGS. 1 and 8. Since the pressure zones 28-31 are opposite the gap 38 in the pump housing, fluid can flow along the jacket face 27 as shown by the arrows in FIGS. 4 and 8. These fluids function to prevent the metal parts of pump body 6 from touching the control tap 8.

Since this leaked fluid is also under pressure, the pressure spreads over the entire area covered by the pressure zones, and two pressure zones whose force is equal to that of pressure channel 18 but acts in the opposite direction, appear on the side of the control tap 8 which faces away from the pressure conduit 18.

Zones 30 and 31 operate in a similar fashion, but the channels 32 of these two pressure zones 30 and 31 discharge into the intake opening 12 in a manner not shown in detail. This produces a pressure reduction originating at the pressure zones 30 and 31.

The operation of the pressure zone is explained in more detail with reference to FIG. 11 to 13.

FIG. 11 shows a partial cross section of the pump body 6 and the control tap 8 of the radial piston pump with a pocket-like pressure zone 36 as is presently known. A pressurized fluid enters the pocket 36 through an inflow conduit 37. Since the pressurized medium in the pocket 36 is given no real directional flow even when the pump body 6 i rotated relative to the control tap 8, the pressure in all areas of the chamber is roughly equal, and the force acting on the pump body 6 is equal in both strength and direction, as is shown graphically in the figure.

Figure 13:
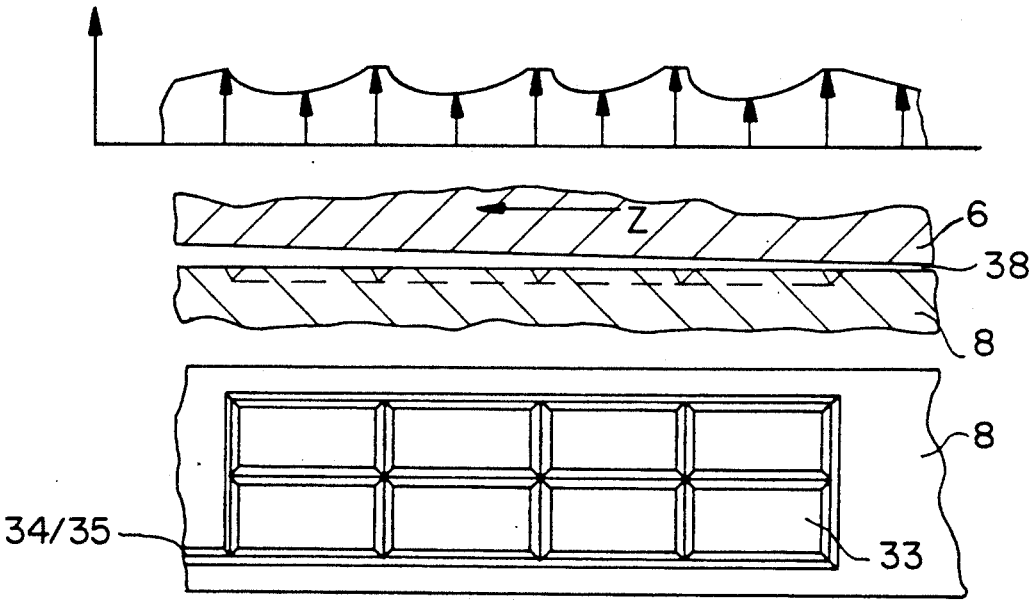
FIG. 13 is similar to FIG. 12 but with increasing gap height in the direction of rotation.

In accordance with FIGS. 12 and 13; however, the pressure zones 28 to 31 are formed by a network of supply conduits. The jacket face segments 33 lie between these.

A gap 38 formed between the pump body 6 and the control tap 8. The spacing of the gap is not to scale in the drawing. In fact, the depth of the conduit 32 should be approximately 150 times that of the gap 38, so that the flow rate in the conduit 32 is low, and practically equal pressure is maintained in the entire network of conduits 32 and the pressure zones 28 to 31.

Since the jacket face segments 33 are surrounded on all sides by conduits under equal pressure, the segments 33 are under equal pressure with the pump at rest.

If the pump body 6 is rotated relative to the control tap 8, a drag current arises in the gap 38 over the corresponding segment 33, that is, the pressurized medium is dragged in the direction of rotation of the pump body 6.

If the spacing h of the gap decreases in the direction of rotation z of the pump body 6 (converging gap), an additional, dynamic pressure arises which is added to the static pressure. FIG. 12 graphically points this out.

In the opposite case, that is, increasing gap spacing in the direction of rotation as is shown in FIG. 13 (diverging gap), the dynamic pressure is subtracted from the static pressure. This means that the resultant force from the pressure zones 28 to 31 increases with a converging gap and decreases with a diverging gap.

If the force resulting from the pressure zone is insufficient to compensate for the other forces acting on the pump body 6, the pump body 6 will be pressed against the control tap 8. This produces a converging gap above the corresponding pressure zone and a corresponding increase in pressure, as is shown in FIG. 12. If, on the other hand, the force resulting from the pressure zones 28 to 31 is stronger, a diverging gap forms (FIG. 13) with a corresponding drop in pressure. The tendency is for the dynamic pressure changes to have a stabilizing effect on the pump body 6. The effect on the control tap 8 is an increase in capacity in comparison to presently known examples under similar conditions.

The foregoing relates to a preferred exemplary embodiment of the invention it being understood that other variants and embodiments thereof are possible within the spirit and scope of the invention, the latter being defined by the appended claims.

What is claimed and desired to be secured by Letters Patent of the United States is:

1. An apparatus including a pump housing, a radial piston device in said pump housing, a fluid flow control tap fixed in said pump housing, a pump body that rotates around said control tap, spring loaded radially moving pistons in said pump, said radially moving pistons from a pumping chamber (11) with said fluid flow control tap, for a flow medium being pumped, said pumping chamber being able to be connected with both an intake bore and a pressure bore, a first pair of pressure zones and a second pair of pressure zones formed in a jacket face (27) of said fluid flow control tap, said first and second pairs of pressure zones (28, 29), (30, 31) are formed by circumferential groove-like conduits and groove-like conduits transverse to said circumferential groove-like conduits which form a plurality of jacket face segments in each of said first and second pairs of pressure zones, said jacket face segments being flush with the jacket face (27) and forming areas which in cooperation with said rotatable pump body generate hydrodynamic fluid pressures greater than a pressure fed into said groove-like circumferential and transverse conduits.

2. An apparatus as defined by claim 1, in which said second pair of pressure zones (28, 29) are radially opposite a pressure conduit (18) through which a flow medium is pumped from said pumping chamber (11) into a pressure bore (13) in said fluid flow control tap.

3. An apparatus as defined by claim 2, in which said second pair of pressure zones (28, 29) lie on at least one side of an intake conduit (16) which connects the pumping chamber (11) with an intake bore (12) in said fluid flow control chamber.

4. An apparatus as defined by claim 2, which includes at least one branch conduit (34, 35) that extends from said second pair of pressure zones (28, 29) along the jacket face (27) to another side of the fluid flow control tap (8).

5. An apparatus as defined by claim 3, which includes at least one branch conduit (34, 35) that extends from said second pair of pressure zones (28, 29) along the jacket face (27) to another side of the fluid flow control tap (8).

6. An apparatus as defined by claim 4, in which said at least one branch conduit (34 and 35) that extends from said second pair of pressure zones (28, 29) to another side of said control tap (8), receives a pressure conduit (18) between them.

7. An apparatus as defined by claim 5, in which said at least one branch conduit (34 and 35) that extends from said second pair of pressure zones (28, 29) to another side of said control tap (8), receives a pressure conduit (18) between them.

8. An apparatus as defined by claim 3, in which each of said first pair of pressure zones (30, 31) are disposed on opposite sides of said pressure conduit (18).

9. An apparatus as defined by claim 4, in which each of said first pair of pressure zones (30, 31) are disposed on opposite sides of said pressure conduit (18).

10. An apparatus as defined by claim 5, in which each of said first pair of pressure zones (30, 31) are disposed on opposite sides if said pressure conduit (18).

11. An apparatus as defined by claim 6, in which each of said first pair of pressure zones (30, 31) are disposed on opposite sides of said pressure conduit (18).

12. An apparatus as defined by claim 7, in which each of said first pair of pressure zones (30, 31) are disposed on opposite sides of said pressure conduit (18).

13. An apparatus as defined by claim 7, in which said conduits (32) of said first pair of pressure zones (30, 31) are connected to said intake conduit (16) via transverse bores.

14. An apparatus as defined by claim 1, in which said conduits (32) have a depth or width which is at least one hundred times that of a spacing (h) of a gap (38) formed between a portion of the pump body (6) and the control tap (8).

15. An apparatus as defined by claim 2, in which said conduits (32) have a depth or width which is at least one hundred times that of a spacing (h) of a gap (38) formed between a portion of the pump body (6) and the control tap (8).

16. An apparatus as defined by claim 3, in which said conduits (32) have a depth or width which is at least one hundred times that of a spacing (h) of a gap (38) formed between a portion of the pump body (6) and the control tap (8).

17. An apparatus as defined by claim 4, in which said conduits (32) have a depth or width which is at least one hundred times that of a spacing (h) of a gap (38) formed between a portion of the pump body (6) and the control tap (8).

18. An apparatus as defined by claim 6, in which said conduits (32) have a depth or width which is at least one hundred times that of a spacing (h) of a gap (38) formed between a portion of the pump body (6) and the control tap (8).

19. An apparatus as defined by claim 13, in which said conduits (32) have a depth or width which is at least one hundred times that of a spacing (h) of a gap (38) formed between a portion of the pump body (6) and the control tap (8).

20. An apparatus as defined by claim 1, in which said conduits (32) are formed by means such as rolling, stamping or etching.

21. An apparatus as defined by claim 1, in which part of said grooves are oriented substantially in a circumferential direction and part of said grooves are oriented substantially in parallel to a longitudinally axis of said control tap.

22. An apparatus as set forth in claim 1 in which a gap (38) is formed between the pump body (6) and the control tap (8) and the jacket face segments (33) form areas which in cooperation with the rotatable body are able to generate hydrodynamic fluid pressures which are greater or smaller than a pressure fed into said circumferential and transverse groove-like conduits depending upon whether the gap between the segments (33) and the pump body are increasing or decreasing in the direction the pump body is driven.

23. An apparatus including a pump housing, a radial piston device in said pump housing, a fluid flow control tap fixed in said pump housing, a pump body that rotates around said control tap, spring loaded radially moving pistons in said pump, said radially moving pistons form a pumping chamber (11) with said fluid flow control tap, for a flow medium being pumped, said pumping chamber being able to be connected with both an intake bore and a pressure bore, a first pair of pressure zones and a second pair of pressure zones in a jacket face (27) of said fluid flow control tap, said first and second pairs of pressure zones (28, 29), (30, 31) are formed by circumferential groove-like conduits and groove-like conduits transverse to said circumferential groove-like conduits which form a plurality of jacket face segments (33) in each of said first and second pairs of pressure zones, said jacket face segments being flush with the jacket face (27) and forming areas which in cooperation with said rotatable pump body generate hydrodynamic fluid pressures greater than a pressure fed into said circumferential and transverse groove-like conduits, said pair of pressure zones (28, 29) are radially opposite a pressure conduits (18) through which a flow medium is pumped from said pumping chamber (11) into a pressure bore (13) in said fluid flow control tap, at least one circumferential branch conduit (34, 35) that extends from said pair of pressure zones (28, 29) along the jacket face (27) to another side of the fluid flow control tap (8), and said pair of pressure zones (30, 31) are disposed on opposite sides of said pressure conduit (18) in the same portions of said jacket face (27).

24. An apparatus as defined by claim 23, in which said conduits (32) have a depth or width which is at least one hundred times that of a spacing (h) of a gap (38) formed between a portion of the pump body (6) and the control tap (8).

25. An apparatus as set forth in claim 23 in which a gap (38) is formed between the pump body (6) and the control tap (8) and the jacket face segments (33) form areas which in cooperation with the rotatable body are able to generate hydrodynamic fluid pressures which are greater or smaller than a pressure fed into said circumferential and transverse groove-like conduits depending upon whether the gap between the segments 33 and the pump body are increasing or decreasing in the direction the pump body is driven.

* * * * *